United States Patent [19]

Horii

[11] 4,436,205

[45] Mar. 13, 1984

[54] AMPULE CASE

[75] Inventor: Isamu Horii, Osaka, Japan

[73] Assignee: Fujisawa Pharmaceutical Co., Ltd., Osaka, Japan

[21] Appl. No.: 363,920

[22] Filed: Mar. 31, 1982

[30] Foreign Application Priority Data

Apr. 3, 1981 [JP] Japan ..... 56-50897

[51] Int. Cl.[3] ..... B65D 85/42; B65D 73/00

[52] U.S. Cl. ..... 206/530; 206/443; 206/460; 206/813; 206/820; 206/528

[58] Field of Search ..... 206/528, 530, 443, 460, 206/820, 813, 485

[56] References Cited

U.S. PATENT DOCUMENTS

| | | | |
|---|---|---|---|
| 1,509,123 | 9/1924 | Binder | 206/443 |
| 2,001,798 | 5/1935 | Schreiber | 206/813 X |
| 2,339,555 | 1/1944 | Glass | 206/820 X |
| 2,808,926 | 10/1957 | Drake et al. | 206/530 |
| 2,891,663 | 6/1959 | Benander | 206/328 |
| 3,276,574 | 10/1966 | Meyers | 206/820 X |

FOREIGN PATENT DOCUMENTS

| | | | |
|---|---|---|---|
| 1049050 | 12/1953 | France . | |
| 1306399 | 2/1963 | France . | |
| 2,496,062 | 6/1982 | France | 206/528 |
| 845004 | 8/1962 | United Kingdom | 206/528 |

*Primary Examiner*—William T. Dixson, Jr.
*Assistant Examiner*—Brenda J. Ehrhardt
*Attorney, Agent, or Firm*—Jordan B. Bierman; Linda Bierman; C. Cornell Remsen, Jr.

[57] ABSTRACT

An ample case is made of a base sheet folded into a rectangular form when seen in side elevation. Ampules are accommodated in the case, being spaced side by side at with the bottoms of the ampules adhering to the bottom wall of the case. When an ampule is to be used, a segment of the base sheet is separated off with the ample attached thereto along a severance line formed in the base sheet between adjacent ampules. A side wall of the case bears the name of the preparation in the ampules and like required information, thus eliminating the necessity of printing or labelling the ampules individually.

7 Claims, 6 Drawing Figures

AMPULE CASE

The present invention relates to a case for containing ampules, especially ampules filled with injection solutions or the like.

It is required that containers or wrappers having pharmaceutical preparations directly enclosed therein bear the name, amount, manufacturer's name, production number, etc. of the preparation. With ampules containing injection solutions or the like, it has been conventional practice to print such items of information directly on the surface of the trunk of each ampule or to affix to the ampule trunk a label bearing the information printed thereon. Thus, insofar as these methods are used, the ampules must be printed or labelled individually, but the procedure is cumbersome and renders the product costly.

Furthermore ampules individually printed or labelled are usually contained in a wave-like shock-absorbing case a so-called Londorationale case, having a wave-like accommodating portion, and the case is placed into an outer box in the form of a rectangular tube for transport or storage. Although this case has outstanding shock-absorbing properties and has been in use for years, such cases, which have a flat bottom and a wavy upper portion, can not be fitted together compactly in layers, so that even before accommodating ampules, the case requires the same space as when containing ampules. The case itself is therefore inefficient to transport and store before use.

To overcome the above drawbacks, we have carried out intensive research and successfully developed a case of entirely novel type for containing ampules efficiently, unlike the conventional shock-absorbing case, without involving the necessity of printing or labelling the individual ampules.

Typical embodiments of this invention will be described below in detail with reference to the accompanying drawings, in which.

Figure 1:
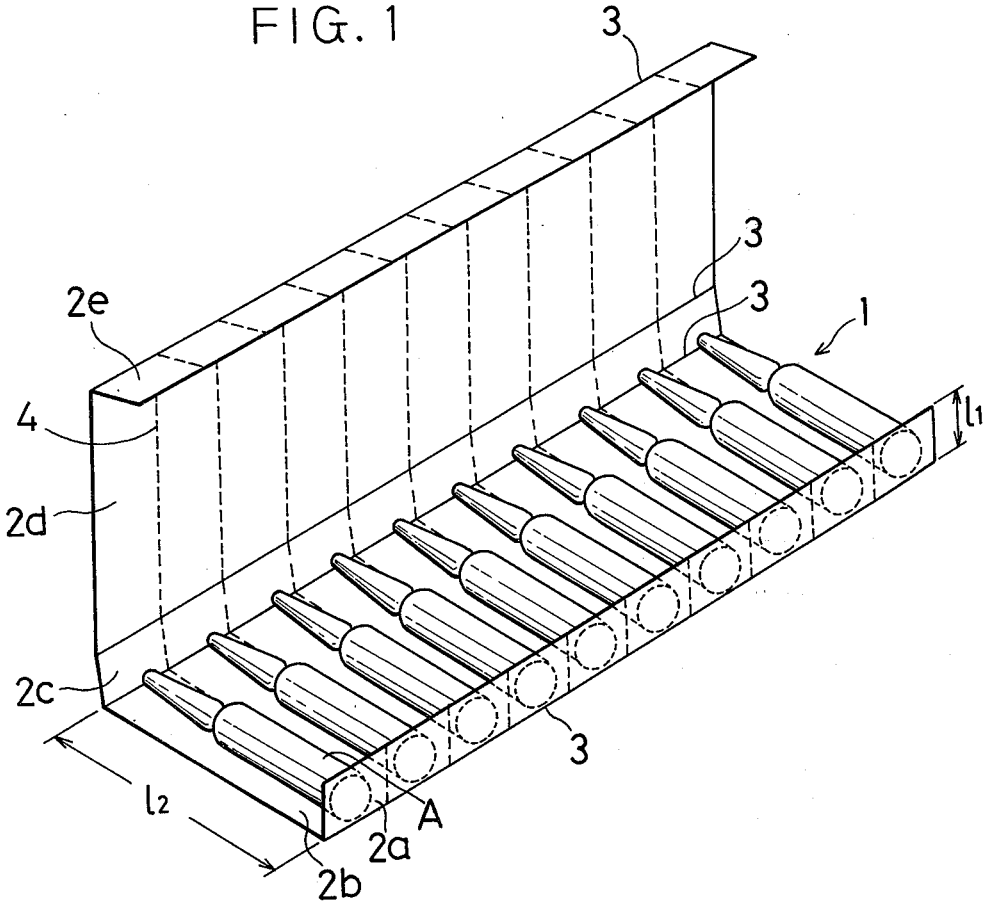
FIG. 1 is a perspective view of an ampule case embodying the invention showing the case in an open state.

FIGS. 1 to 4 show an ampule case 1 embodying a preferred form of the invention. FIG. 1 is a perspective view showing the case 1 in an open state. The case 1 is adapted to contain ten ampules A as arranged in a lateral row. The case 1 is made of a base sheet 2 of thick paper which comprises bottom walls 2*a* and 2*e*, side walls 2*b* and 2*d*, and a top wall 2*c*. The bottom walls 2*a*, 2*e* and the top wall 2*c* have a width $L_1$ slightly larger than the outside diameter of the trunk of the ampule A. The side walls 2*b*, 2*d* have a length $L_2$ slightly larger than the length of the ampule A. Lateral fold lines 3 are formed in any suitable manner as by a Thomson die cutter between each two adjacent walls of the bottom wall 2*a*, side wall 2*b*, top wall 2*c*, side wall 2*d* and bottom wall 2*e*, whereby the adjacent walls are made foldable over each other. The ampules A are secured, each at its bottom, to the upper surface of the bottom wall 2*a* with an adhesive (hotmelt). The base sheet 2 is scored with a lengthwise severance line (perforations) 4 between each two adjacent ampules A. The name of the medicinal preparation contained in the ampules and other required items are printed on the inner surface of the side wall 2*b*. This eliminates the necessity of printing or labelling the individual ampules A.

Figure 2:
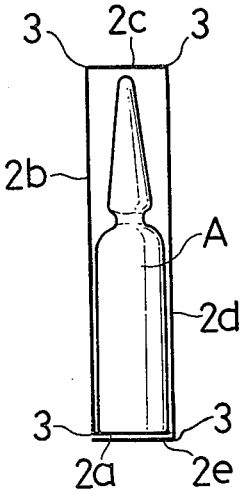
FIG. 2 is a side elevation showing the case in its closed state.
Figure 3:
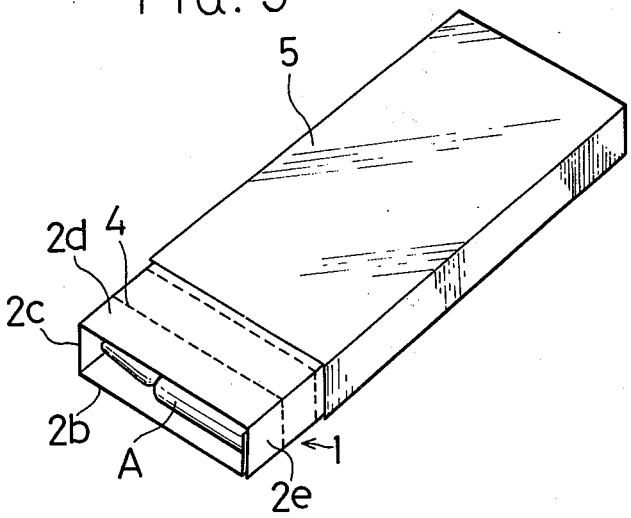
FIG. 3 is a perspective view showing the case as partly placed into an outer box.

The ampule case 1 can be fabricated by preparing a planar base sheet 2 scored with fold lines 3 and severance lines 4 and having printed thereon the name of the medicinal preparation and other required items, securing the bottoms of ampules A to the bottom wall 2*a* of the base sheet 2 by usual means such as a hotmelt or like adhesive, and thereafter folding the base sheet 2 inward, i.e. the ampule enclosing direction, through an angle of 90° along each of the fold lines 3 into a rectangular form in side elevation as shown in FIG. 2. The ampule case 1 thus made is placed into an outer box 5 in the form of a rectangular tube for transport or storage as seen in FIG. 3. While the name of the pharmaceutical product including ten ampules as a unit and other particulars are given on the surface of the outer box 5, the case 1 may be made to bear a similar identification. For example, a seal or wrapper (not shown) with the required items of information printed thereon may be affixed to the case 1 across the side walls 2*b*, 2*d*.

To render the ampule easily cuttable by forming a so-called one-point cut on the ampule, the bottoms of ampules A are adhered to the bottom wall 2*a*, the bottom wall 2*a* is then bent toward the side wall 2*b* through 90° along the fold line 3 and a one-point cut is thereafter formed on each of the ampules A thus arranged on a plane, whereby the cuts can be provided as oriented in a specified direction, hence convenient. Further when desired, one-point marks can be made also in the same manner as above.

Figure 4:
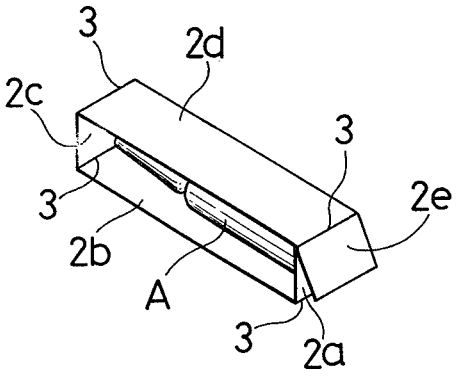
FIG. 4 is a perspective view showing a segment of the case as separated off for an ampule before use.

When the ampules A accommodated in the case 1 of the invention are to be used, a segment of the base sheet 2 is separated off along the severance line 4 for each ampule A as seen in FIG. 4. When the ampule A is cut as held between the side walls 2*b* and 2*d*, the possible injury by glass fragments is avoidable. Although the base sheet 2 is made of thick paper according to the foregoing embodiment, the material for the base sheet 2 is not limited thereto; for example, double-faced corrugated board, plastics, etc. are usable. While the fold line 3 is formed by a Thomson die cutter and the severance line 4 is a series of perforations, these lines 3 and 4 are not limitative but any means is usable for forming such lines provided that the contemplated object can be fulfilled. The name of the medicinal preparation and other items, which are given on the inner surface of the side wall 2*b* in the foregoing embodiment, may be displayed at any other location.

Figure 5:
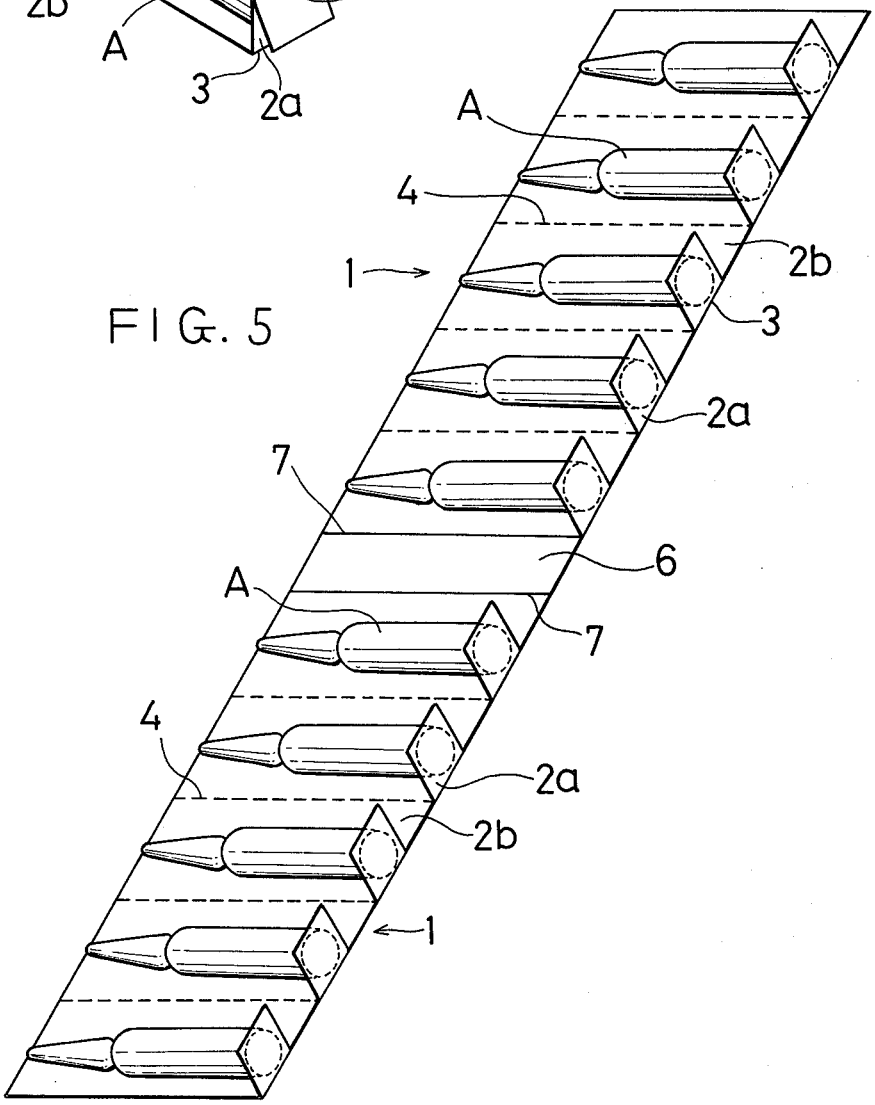
FIGS. 5 and 6 are perspective views showing other individual embodiments, with two component cases in an open state.
Figure 6:
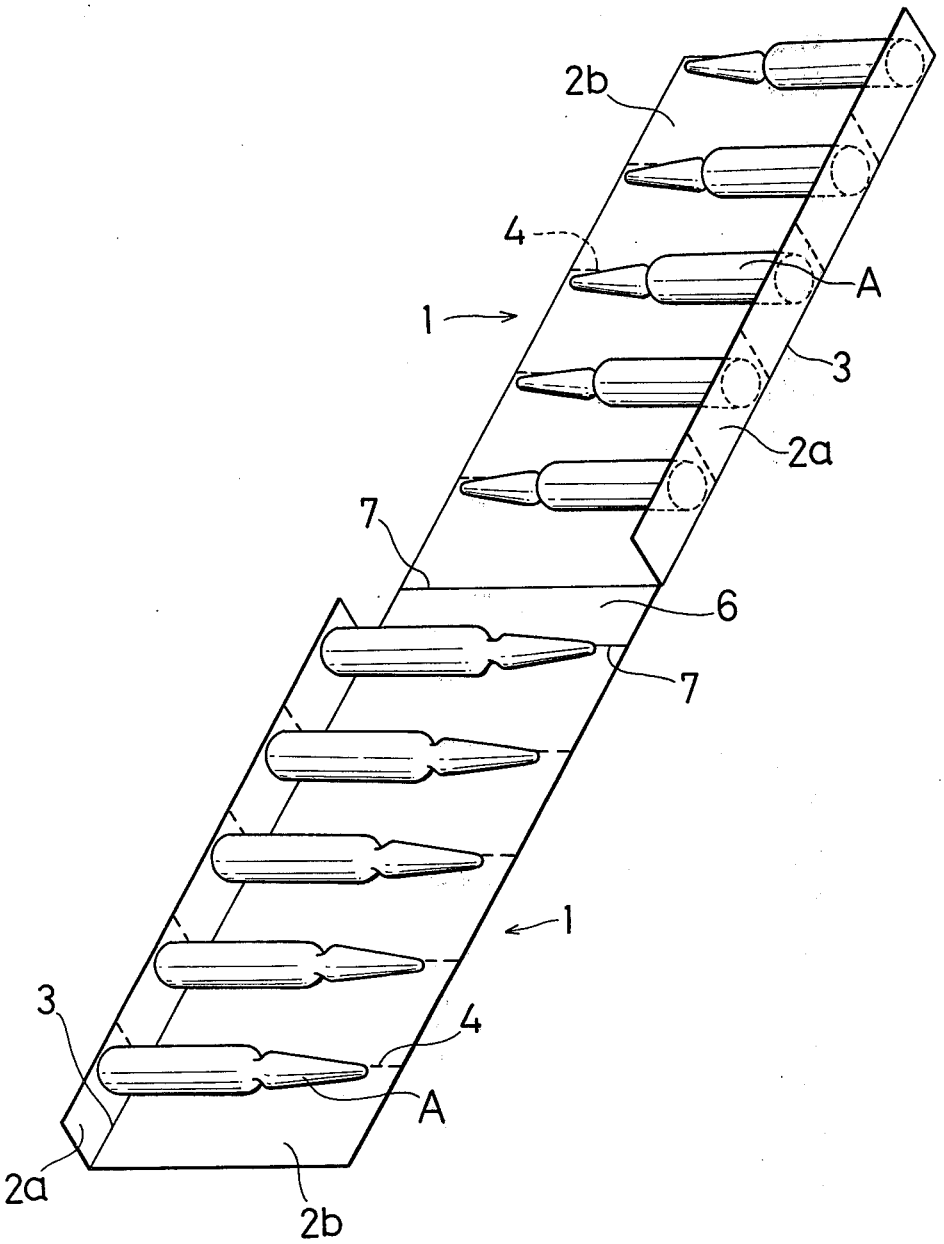

FIGS. 5 and 6 are perspective views showing other individual embodiments of the invention, each with cases 1 in an open state. With these embodiments, the two cases 1 are interconnected by a connecting portion 6 having approximately the same width as the bottom wall 2*a*. Fold lines 7, 7 are formed between the connecting portion 6 and the cases 1, 1. When the cases 1, 1 are folded inward along these fold lines 7, 7 to wrap ampules A and to overlie each other, the ampules A on one case 1 are positioned alternately with the ampules A on the other case 1. With these embodiments, it is convenient to display the name of the preparation and other items for the combined cases on the outer surface of the connecting portion 6.

According to the present invention, the ampules are secured to the base sheet individually, thereby held out of contact with one another and can therefore be protected effectively. Because there is no need to print or label the ampules individually and further because it is unnecessary to use wave-shaped shock-absorbing cases which are inconvenient to store before use, the invention assures a great cost reduction in packaging pharmaceutical products for injection uses. In addition to these outstanding advantages, the ampule case of this invention has the following attendant advantages.

(a) The name of the medicinal preparation, etc. which are given on the planar base sheet are visible with greater ease than those conventionally shown on the curved surface of the ampule trunk.

(b) Such a name and other particulars, which can be displayed over an increased area, can be made legible more easily, for example, with use of larger printing types.

These advantages (a) and (b) combine to afford the great advantage of eliminating errors involved in the administration of drugs.

(c) The ampules, even if separated off individually, are still held attached to the base sheet, therefore will not roll along and are convenient to handle.

(d) Since the ampule bears no marking on its outer periphery, the contents are easy to check, for example, for foreign matter.

(e) With the ampule enclosed by the base sheet before use, the preparation therein is shielded from light.

(f) After use, the display portion of the base sheet can be attached, for example, to a clinical chart for reference.

Because of the various advantages stated above, the ampule case of the invention is very useful.

What is claimed is:

1. An ampule case comprising one or more L-shaped base sheets in which the long side of each L extends along one side of the ampule, means effecting adherence between the short side of each L and the bottom side of each ampule and means formed as an integral extension of each base sheet covering at least one other dimension of said ampule.

2. An ampule case according to claim 1, in which the long side of each base sheet is slightly longer than the length of the ampule to be covered, and the width of said long side and the width and breadth of the short side of each sheet is slightly larger than the greatest outside diameter of said ampule.

3. An ampule case according to claim 2, in which said integral extension includes a first section extending from one end at right angles to the long side of said L for a distance sufficient to cover the top of said ampule, a second section extending from one end at the other end of said first section to cover another long side of said ampule opposite to said first long side and a third section extending from one end of the other end of said second section about and for a distance substantially equal to the short side of said L.

4. An ampule case according to claim 2, in which a first plurality of said base sheets are detachably connected one with the other on the long side of the L and in which said means formed as an integral extension comprises an equal second plurality of base sheets connected to said first plurality of base sheets by a blank rectangular section and in which each individual base has a width double the size of the short side of the L to which an ampule is attached, whereby said ampules are spaced from one another along said connected base sheets by a distance equal to the space required for one ampule, and whereby when said second plurality of base sheets are inwardly folded over the first plurality of base sheets the two sets of base sheets overlap one another to form a package of alternately attached ampules all adhering at the same end.

5. An ampule case according to claim 2, in which a first plurality of base sheets are detachably connected one with the other along the long side of the L, said first plurality of base sheets having the short end of said L extending from one end thereof, in combination with a second equal plurality of base sheets connected to said first plurality of base sheets by a blank rectangular section and having the short end of said L extending from the opposite end thereof, and in which each base sheet has a width double the size of the short side of the L to which an ampule is attached, whereby said ampules are spaced from one another along said connected sheets by a distance equal to the space required for one ampule, and whereby when said second plurality of base sheets are inwardly folded over said first plurality of base sheets the two sets of base sheets overlap one another to form a package of alternately stacked ampules adhering to alternate ends of the overlapping sheets.

6. An ampule case according to claim 3 in which a plurality of base sheets are detachably connected to one another along adjacent long sides of individual base sheets, in combination with an open-ended box having internal dimensions substantially equal to the long and short sides of said L, into which the plurality of connected ampule cases are adapted to fit.

7. An ampule case according to claims 4 or 5 in combination with an open-ended box for containing said ampules having an internal dimension substantially equal to the external dimension of said package of ampules.

* * * * *